United States Patent [19]

Nishitsuji et al.

[11] Patent Number: 4,914,476

[45] Date of Patent: Apr. 3, 1990

[54] DEVICE FOR DISPLAYING WARM-UP WAITING TIME OF IMAGE FORMING APPARATUS

[75] Inventors: Hidefumi Nishitsuji; Kunio Kudoh, both of Yokohama, Japan

[73] Assignee: Ricoh Company, Ltd., Tokyo, Japan

[21] Appl. No.: 259,907

[22] Filed: Oct. 19, 1988

[30] Foreign Application Priority Data

Oct. 19, 1987 [JP] Japan ..... 62-158768[U]

[51] Int. Cl.[4] ..... G03G 21/00

[52] U.S. Cl. ..... 355/208; 219/216; 355/209; 355/290

[58] Field of Search ..... 355/282, 285, 289, 290, 355/203, 204, 206, 208, 209; 219/216; 340/588

[56] References Cited

U.S. PATENT DOCUMENTS 4,373,802 2/1983 Yuge et al. ..... 355/209
4,618,247 10/1986 Tsuji ..... 355/208
4,672,177 6/1987 Headrick ..... 219/216
4,686,351 8/1987 Nakauchi ..... 355/290
4,821,062 4/1989 Katoh et al. ..... 219/216

*Primary Examiner*—Fred L. Braun
*Assistant Examiner*—Susan Luddy
*Attorney, Agent, or Firm*—Oblon, Spivak, McClelland, Maier & Neustadt

[57] ABSTRACT

A device installed in a copier, facsimile apparatus or similar image forming apparatus of the type including a fixing unit displays a waiting time necessary for the warm-up of the apparatus. The device calculates an elevation rate of fixing temperature within a predetermined time interval, produces a difference between a current temperature of the fixing unit and a set fixing temperature on the basis of the elevation rate, and thereby determines a waiting time. Further, the waiting time is determined on the basis of a temperature inside the apparatus when the ambient temperature is comparatively low and on the basis of a temperature of the fixing unit when it is higher than a predetermined level.

9 Claims, 10 Drawing Sheets

| FIG.4A | FIG.4B |
|---|---|

DEVICE FOR DISPLAYING WARM-UP WAITING TIME OF IMAGE FORMING APPARATUS

BACKGROUND OF THE INVENTION

The present invention generally relates to a copier, facsimile apparatus or similar image forming apparatus of the type including a fixing unit and, more particularly, to a device for displaying a waiting time necessary for the warm-up of a heating element of such an image forming apparatus.

There has been known a copier, facsimile apparatus or similar image forming apparatus of the type including a fixing unit, a temperature sensor responsive to the temperature of the fixing unit, and a display responsive to an output of the temperature sensor for determining and displaying a waiting time which is necessary for warming up the apparatus. It is a common practice with this type of image forming apparatus to sense the temperature of the surface of a fixing element in the form of a fixing roller by using a thermistor. One approach available for displaying the sensed temperature is transforming an output of the thermistor into a voltage and sequentially turning on a plurality of light emitting diodes in respone to the variation of the voltage. Another approach is displaying the sensed temperature on a display which is adapted to show the number of copiers.

In practice, however, the waiting time necessary for the warm-up of a fixing unit is dependent upon the elevation rate of temperature which is in turn dependent upon the input voltage, ambient temperature, etc. Especially, since a thermistor associated with a fixing roller is designed to operate at temperatures of 180° C. to 190° C., it is incapable of sensing temperatures close to room temperature with accuracy. Heretofore, no consideration has been given to the differences of input voltage and the variations of ambient temperature in determining a waiting time based on the temperature elevation rate, resulting in inaccurate detection of waiting time. This problem may be eliminated by sensing the temperature of a fixing roller, determining a waiting time by using a predetermined temperature elevation rate, and displaying such a waiting time, as disclosed in Japanese Laid-Open Patent publication No. 56-164376 by way of example. The present invention constitutes an improvement over the implementation disclosed in this Laid-Open Patent Publication.

SUMMARY OF THE INVENTION

It is therefore an object of the present invention to provide a waiting time displaying device for an image forming apparatus which is capable of sensing and displaying a warm-up waiting time with a minimum of error.

It is another object of the present invention to provide a generally improved device for displaying a warm-up waiting time of an image forming apparatus.

In an image forming apparatus including a fixing unit, a device for determining and displaying a waiting time necessary for the fixing unit to reach an operable temperature of the present invention comprises a fixing unit temperature sensor for sensing a temperature of the fixing unit, a control for calculating a temperature elevation rate per unit time from temperatures of the fixing unit which are sensed at a predetermined time interval, producing a difference between an actual temperature of the fixing unit and a reference fixing temperature set beforehand, and dividing the temperature difference by the temperature elevation rate to produce the waiting time, and a display for displaying the waiting time produced.

Further, in an image forming apparatus including a fixing unit, a device for determining and displaying a waiting time necessary for the fixing unit to reach an operable temperature of the present invention comprises a display for displaying the waiting time, a fixing unit temperature sensor for sensing a temperature of the fixing unit, an ambient temperature sensor for sensing a temperature of the ambience, a computing circuit for comparing a temperature of the fixing unit sensed by the fixing unit temperature sensor and a predetermined reference temperature, and a control for determining the waiting time on the basis of a temperature sensed by the fixing unit temperature sensor when the temperature of the fixing unit is higher than the reference temperature and on the basis of a temperature sensed by the ambient temperature sensor when the temperature of the fixing unit is lower than the reference temperatuare, while causing the display to display the waiting time.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
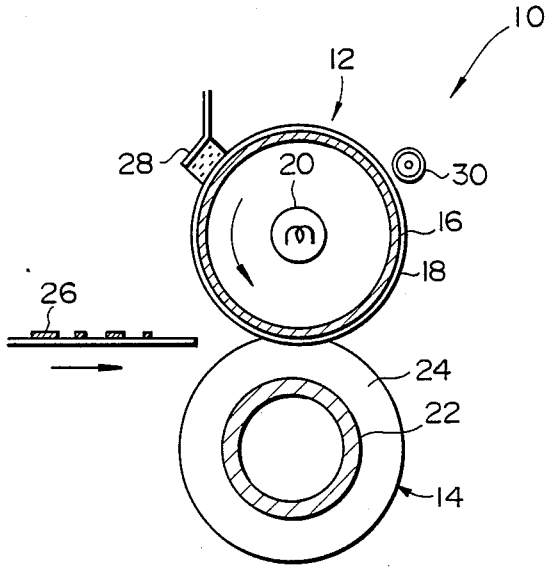
FIG. 1 is a section exemplarily showing a fixing unit to which the present invention is applied.

Referring to FIG. 1 of the drawings, a fixing unit to which the present invention is applied is shown and generally designated by the reference numeral 10. As shown, the fixing unit 10 comprises a fixing roller 12 and a pressing roller 14 held in contact with the fixing roller 12. The fixing roller 12 includes a hollow metal core 16 and a surface layer 18 which is provided on the metal core 16 by Teflon treatment. A heating element 20 is disposed in the hollow metal core 16. The pressing roller 14 is made up of a metal core 22 and a silicon rubber layer 24 provided on the surface of the metal core 22. A paper 26 to which a toner image has been transferred, for example, is fed to between the fixing roller 12 and the pressing roller 14 to fix the toner image by heat and pressure. A thermistor 28 serves as first temperature sensing means and is held in contact with the surface of the fixing roller 12 to constantly sense the temperature of the latter. A temperature fuse 30 is located in close proximity to the surface of the fixing roller 12 so as to protect the roller 12 from unusual temperature elevation.

Figure 2:
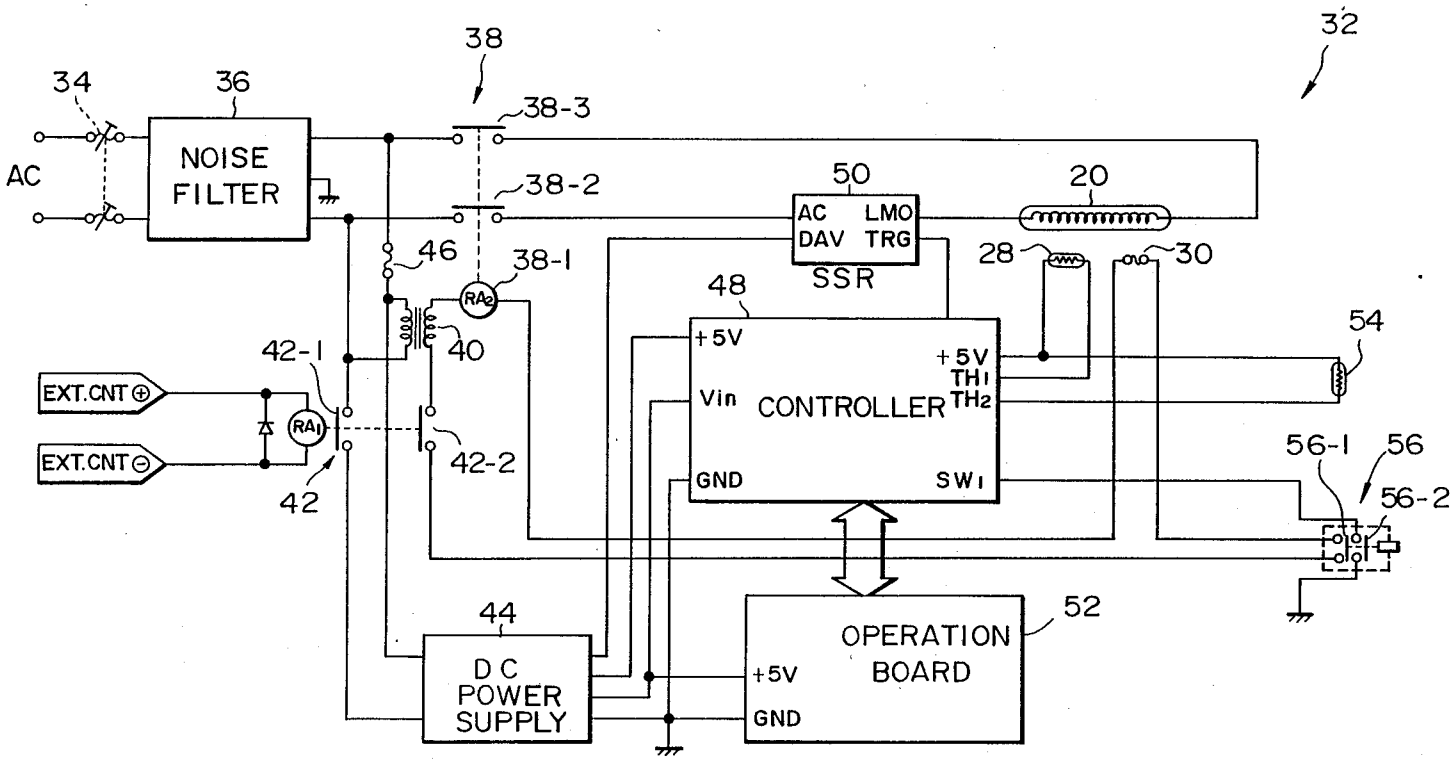
FIG. 2 is a schematic block diagram showing a control system installed in an image forming apparatus which includes the fixing unit of FIG. 1.

Referring to FIG. 2, a control system is shown which may be incorporated in a copier or similar image forming apparatus of the type including the fixing unit 10 of FIG. 1. The control system, generally 32, includes a double circuit breaker 34 for intercepting overcurrent through an AC input line, a noise filter 36 in the form of an inductance-capacitance circuit, an electromagnetic relay 38 for on-off controlling current supply to the heating element 20, a transformer 40, an electromagnetic relay 42, a DC power supply 44, and a miniature circuit breaker 46 actuated when the circuitry made up of the transformer 40, relay 42 and DC power supply 44 fails. The control system 32 further includes a controller 48, a solid state relay 50, and an operation board 52. The heating element 20, thermistor 28 and temperature fuse 30 are connected to the control system 32. Also connected to the control system 32 are a thermistor 54 which serves as second temperature sensing means responsive to an ambient temperature as distinguished from the temperature of the fixing roller 12, and a door switch 56 adapted for interlocking.

More specifically, the circuit breaker 46 assists the circuit breaker 34 whose capacity is too large to respond to slight unusualness. The transformer 40 lowers an input voltage to 24 volts to provide a power source for driving the electromagnetic relay 38. Connected to the secondary side of the transformer 40 are a contact 42-2 of the relay 42, a contact 56-1 of the door switch 56, the temperature fuse 30, and a coil 38-1 of the electromagnetic relay 38. The electromagnetic relay 42 is energized by a signal EXT.CNT to close its contacts 21-1 and 42-2 so that power is supplied to the DC power supply 44. At this instant, if the door switch 56 is closed and the temperature fuse 30 is alive, the relay 38 is energized to close its contacts 38-2 and 38-3 to allow a current to flow through the heating element 20. The transformer 40 lowers the input voltage as stated above because directly using a 200-volt line or similar input power supply for the safety circuit which includes the temperature fuse 30 and door switch 56 is dangerous. When the contact 42-1 of the relay 42 is closed, AC is supplied to the DC power supply 44 to power the various sections of the machine, controller 48, and operation board 52. Further, the input voltage is detected and fed to the controller 48, as described in detail later. A solid state relay 50 is provided for switching the power to the heating element 20. The door switch 56 is comprised of two circuit sections, i.e., a circuit section which includes a contact 56-1 and functions to operate the electromagnetic relay 38, and a circuit section which includes a contact 56-2 and feeds a signal to the controller 48 so that the latter may display a door open condition on the operation board 52.

Figure 3:
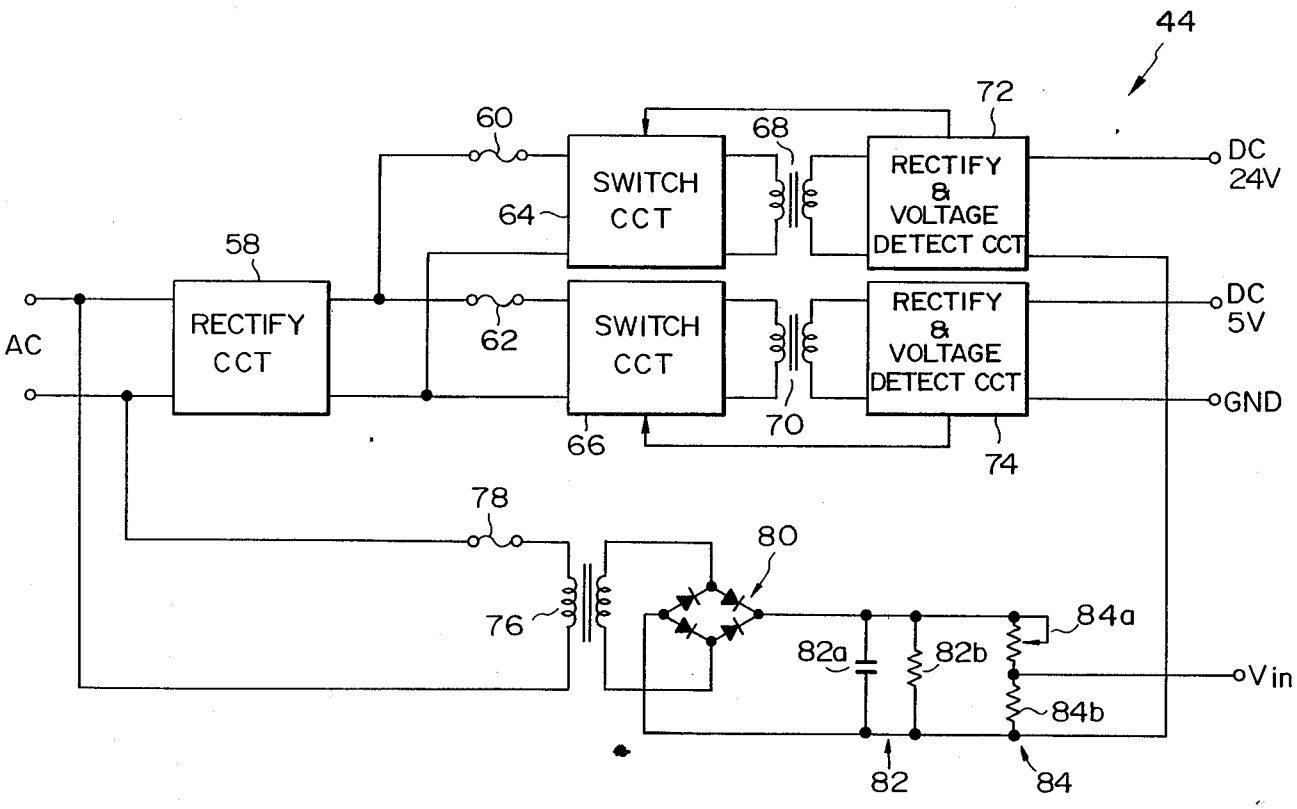
FIG. 3 is a schematic block diagram showing a specific construction of a DC power supply which is included in the control system of FIG. 2.

FIG. 3 shows a specific construction of the DC power supply 44. In the figure, the AC input is rectified by a rectifying circuit 58 and then applied via a fuse 60 or 62 to a switching circuit 64 or 66. The switching circuits 64 and 66 are assigned to a 24-volt circuit and a 5-volt circuit, respectively. The output voltages of the switching circuits 72 or 74 is fed to lowered by transformers 68 and 70 and then rectified again and determined by rectifying and voltage determining circuits 72 and 74. The voltage sensed by any of the circuits 72 or 74 is fed to the controller 48 and a switching circuit of the operation board 52. In this manner, the power supply 44 is implemented as a double-circuit DC power supply and a switching power supply circuit for monitoring the AC input voltage. A transformer 76 is connected at its primary side to the AC input line upstream of the rectifying circuit 58 and at its secondary side to a bridge type full-wave rectifying circuit 80. The full-wave rectifying circuit 80 is connected to a smoothing circuit 82 which is constituted by a capacitor **82*a* and a resistor 82*b*. The smoothing circuit 82 is connected to a voltage dividing circuit 84 which is made up of a semi-fixed resistor 84*a* and a fixed resistor 84*b*. The voltage dividing circuit 84 feeds a divided voltage to an analog-to-digital (AD) converter of the controller 48** in the form of a signal Vin, whereby the input voltage is monitored.

Figures 4, 4A:
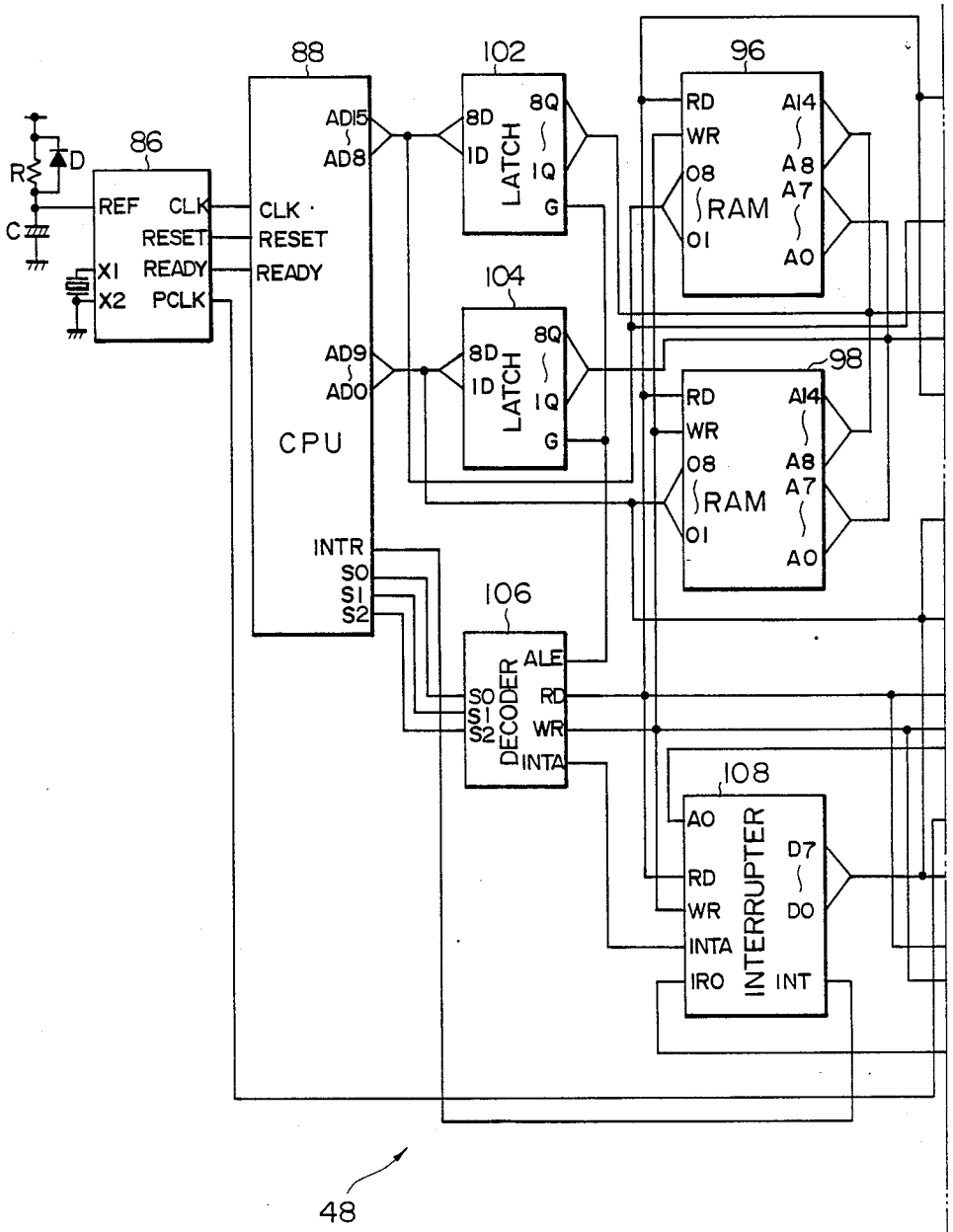
FIG. 4 is a schematic block diagram of a controller also included in the control system of FIG. 2.
Figure 4B:
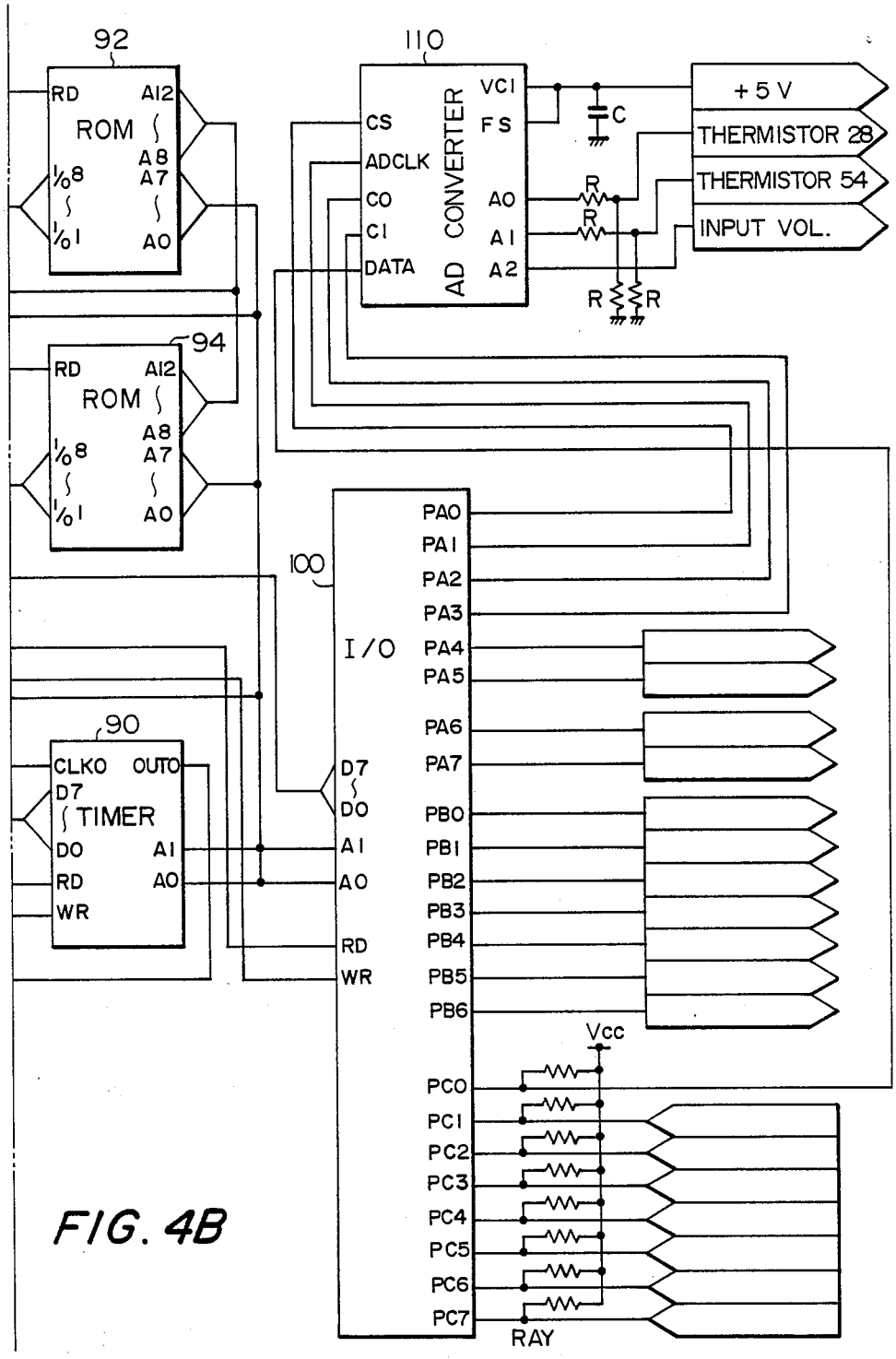

Referring to FIG. 4, a specific construction of the controller 48 is shown. In the figure, a reset clock generator 86 supplies a central processing unit (CPU) 88 with a reset signal and a clock signal. The reset clock generator 86 may be implemented as an integrated circuit. Likewise, other various sections of the controller 48 shown in FIG. 4 may each be implemented as an integrated circuit although not described in detail. Adapted to operate the CPU 88, the clock signal is a signal in the form of a train of 5-megahertz pulses, for example. The reset signal resets the CPU 88 for several tens of milliseconds, for example, when a power switch of the machine is turned on. Further, the reset clock generator 86 supplies a timer 90 with a 2.5-megahertz clock signal. The CPU 88 reads a control program out of a read only memory (ROM) 92 or 94, writes data necessary for control in a random access memory (RAM) 96 or 98, and controls various external sections via an input/output (I/O) interface 100.

The CPU 88 produces an address output and a data output on its output terminals AD0 to AD7 and AD8 to AD15 on a time division basis. Hence, latches 102 and 104 each latches an address output in response to an address latch enable (ALE) signal which is fed thereto from a decoder 106. The decoder 106 decodes signals S0 to S2 from the CPU 88 to thereby produce the ALE signal as well as a read signal RD, a write signal WR, an intacknowledge signal INTA signal, etc. Each of the RAMs 96 and 98 stores data from the CPU 88 and, when received a signal RD from the CPU 88, delivers to the CPU 88 a content of an address which is designated by A0 to A14. ROMs 92 and 94 individually store control programs which the CPU 88 may execute and deliver the programs to the CPU 88 in response to a signal RD from the CPU 88. A signal PCLK (2.5 megahertz) is fed from the reset clock element 86 to the timer 90. Clocked by the signal PCLK, the timer 90 produces pulses of various frequencies and patterns on the basis of a mode and data which are applied thereto from the CPU 88. The reference numeral 108 designates an interrupter.

An I/O interface 100 is provided or accessing sensors and keys which are external inputting elements as well as light emitting diodes (LEDs) for display and the heating element. The I/O interface 100 has three ports A, B and C each having eight bits. The ports A and B are used as output ports while the C port is used as an input port. Lower four bits of the port A are connected to the AD converter 110 while the other bits of the port A and all the bits of the port B are connected to the heating element, a motor for driving the fixing unit, the LEDs of the operation board 52 including LEDs for indicating a waiting time, etc. Signals from ten keys and clear key 112 on the operation board 52 shown in FIG. 5, a temperature display key 114 and a fixing temperature set key 116 are applied to the input port C. Applied to the least significant bit of the port C is a signal DATA from the AD converter 110. The AD converter 110 transforms the analog values (voltage values) of inputs from the thermistors 28 and 54 into digital values (eight bits) and delivers the digital values to the CPU 88. Four different signals are fed from the CPU 88 to the AD converter 110 via the I/O interface 100. While the AD converter 110 is in operation, its input CS is continuously held active (low level). An input ADCLK to the AD converter 110 is adapted to cause the AD converter 110 to produce DATA. In the case that the AD converter 110 has only one data terminal, DATA will be outputted in the form of serial data. Every time a pulse arrives at the input ADCLK, the AD converter 110 produces data eight times, the data of the most significant bit first. Every time the CPU 88 delivers a pulse to the AD converer 110, it reads the zero-th bit of the port C of the AD converter 110 and repeats this eight consecutive times to obtain 8-bit data. The I/O interface 100 has four AD converter circuits therein, and the inputs C0 and C1 of the AD converter 110 are adapted to specify one of the four AD converter circuits. In the illustrative embodiment, the AD converter circuits are selectively operated by the inputs C0 and C1 because the output voltages of the two thermistors 28 and 54 are converted into digital data.

Figure 5:
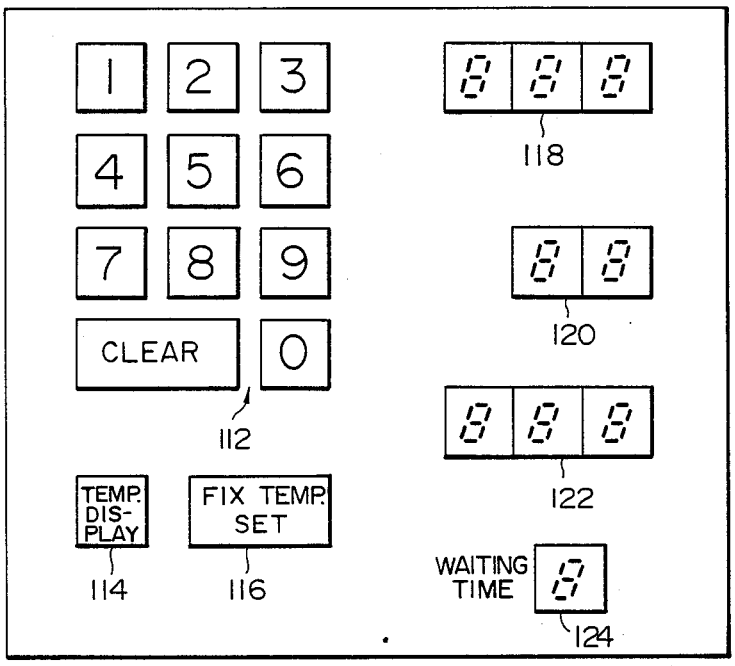
FIG. 5 is a plan view schematically showing an operation board which is included in the control system of FIG. 2.

As shown in FIG. 5, the operation board 52 is provided with the ten keys and clear key 112, temperature display 114 and fixing temperature set key 116 as well as a fixing temperature display 118, an ambient temperature display 120, a set fixing temperature display 122, a waiting time display 124, etc. The ten keys and clear key 112 are operable to enter a desired temperature of the fixing unit 10, e.g. temperature of the fixing roller 12. Usually, an arrangement is made such that the temperature is selectable within the range of 175° C. to 192° C. The temperature entered on the keys 112 appears on the set fixing temperature display 122. When the fixing temperature set key 116 is pressed after the entry of a temperature, the entered value is set as a fixing temperature while, at the same time, a lamp associated with the key 116 is turned on. So long as this lamp is turned on, any further depression of the ten keys and clear key 112 is neglected. When the key 116 is pressed again, the lamp is turned off and another desired temperature may be entered on the ten keys and clear key 112.

When the temperature display key 114 is pressed, a lamp associated with this key 114 is turned on. At the same time, the displays 118 and 120 display respectively a surface temperature of the fixing roller 12 sensed by the thermistor 28 and an ambient temperature sensed by the thermistor 54. Each of the displays 118 and 120 is updated every five minutes. As the temperature display key 114 is operated again, the lamp and displays 118 and 120 are turned off to end the temperature display. The waiting time display 124 is adapted to show a waiting time, or period of time necessary to fully warm up the machine, when the power switch of the machine is turned on or when AC is turned from OFF to ON. The display 124 is turned off when the machine becomes ready to operate.

Figure 6:
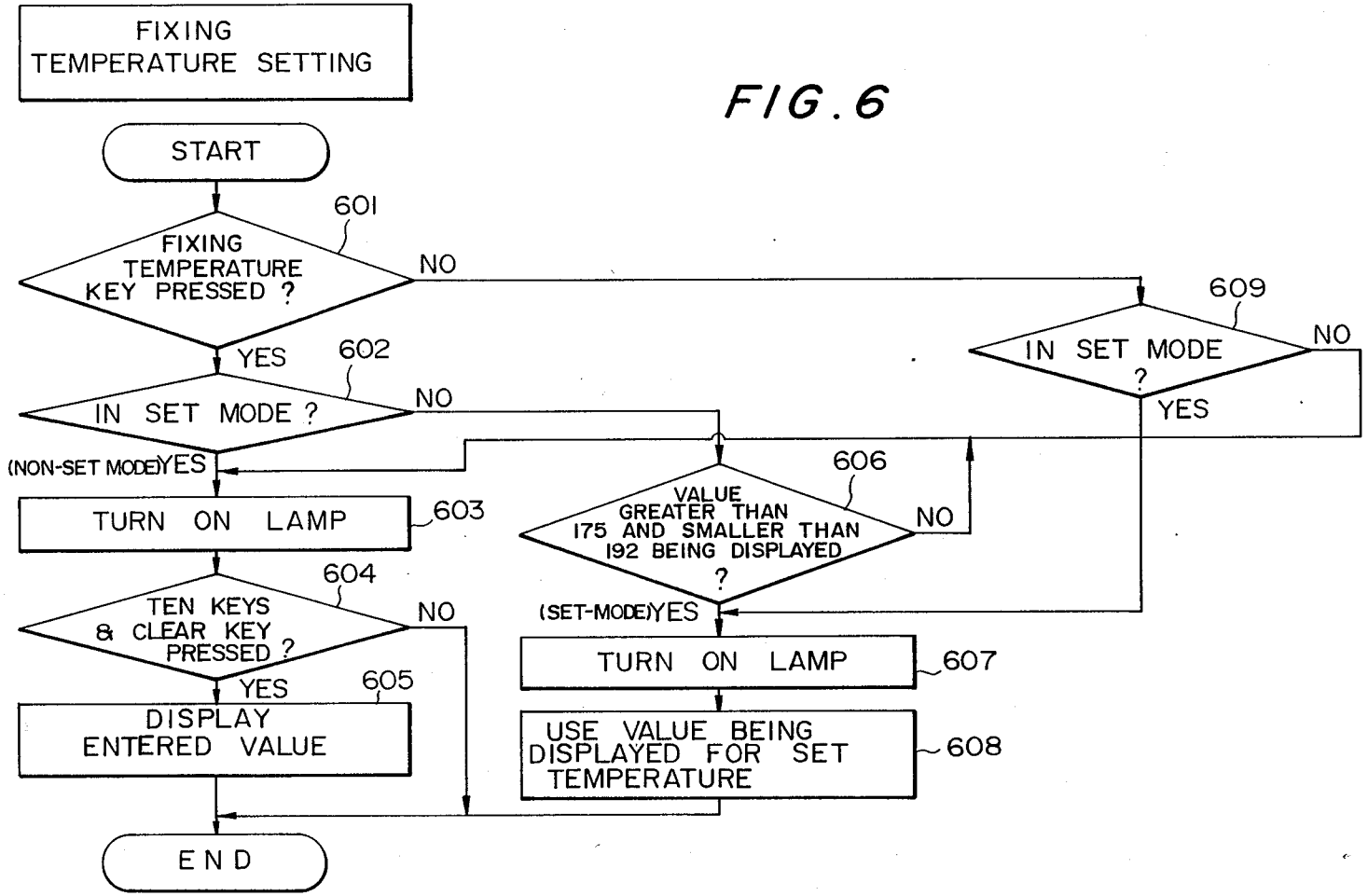
FIG. 6 is a flowchart demonstrating a control procedure associated with the setting of a fixing temperature.

The operation of the control system 32 for setting a fixing temperature will be described with reference to FIG. 6. In the figure, the control system 32 determines whether the fixing temperature set key 116 has been depressed (step 601). If it has been depressed, the system 32 determines whether the current mode is a set mode (step 602). If a set mode has been selected, the system 32 changes it to a non-set mode and, if it has not been selected, the system 32 sets up a set mode. Upon the change of a set mode to a non-set mode, the lamp is turned off (step 603) to allow the entry of data on the ten keys and clear key 112 (step 604). When the ten keys are operated, the resulting value is indicated on the set fixing temperature display 122 (step 605). On the other hand, when a non-set mode is switched to a set mode, the system 32 determines whether the current set value is greater than 175 and smaller than 192 (step 606) and, if the answer is YES, turns on the lamp (step 607) while selecting the value appearing on the display 122 as a set temperature (step 608). At this instant, any value entered on the ten keys is neglected. If the current set value does not lie in the above-mentioned range, a non-set mode is maintained and the program is transferred to the step 603. If the fixing temperature set key 116 has not been pressed, the program advances to a step 609.

Figure 7:
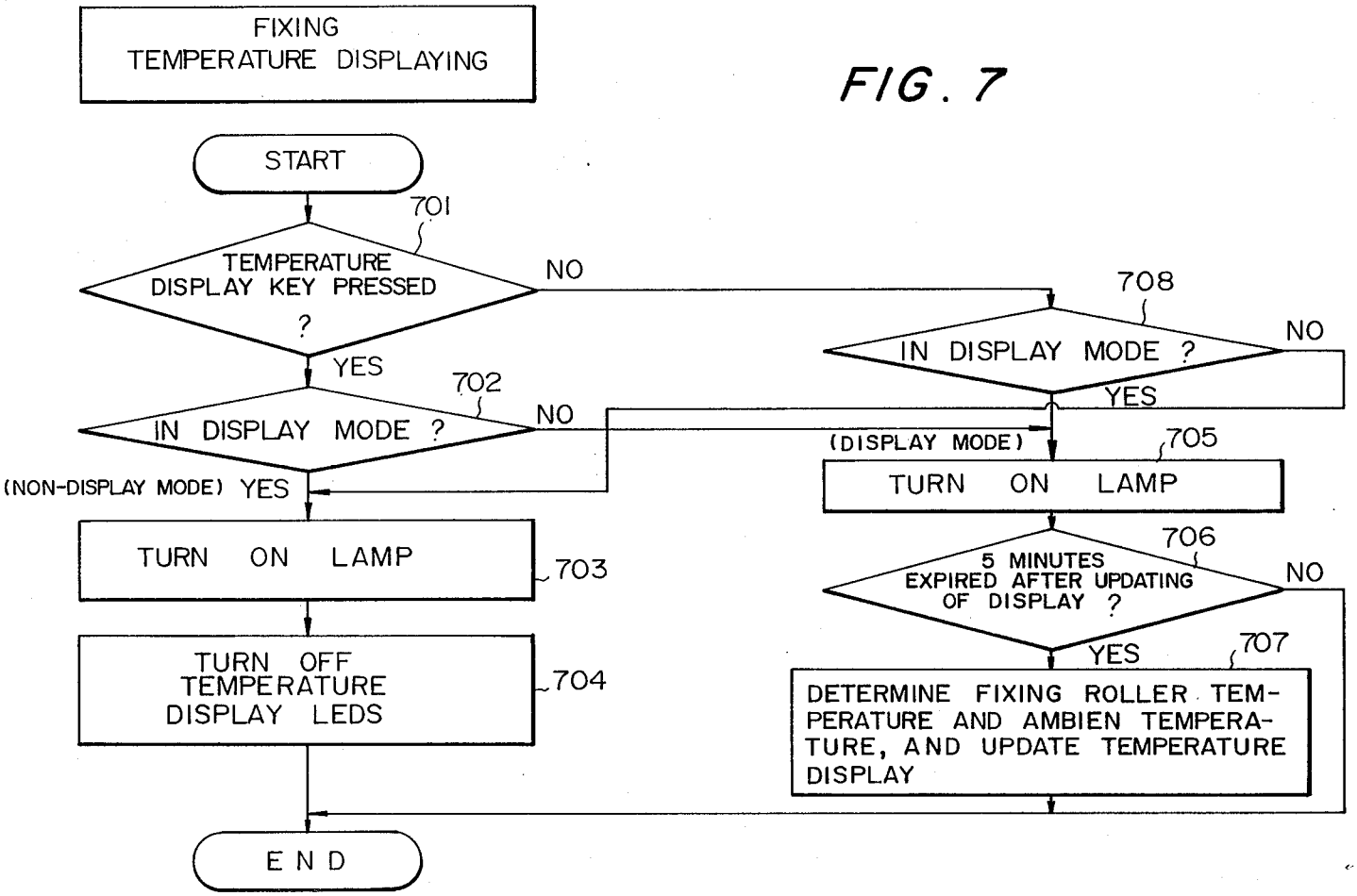
FIG. 7 is a flowchart representative of a control procedure associated with the display of a temperature.

For displaying a fixing temperature, the control system 32 is operated as shown in FIG. 7. As shown, the system 32 determines whether the temperature display key 114 has been depressed (step 701) and, if the answer is YES, whether the current mode is a display mode (step 702). If a display mode has been selected, the lamp is turned off, a non-display mode is set up (step 703), and the temperature display LEDs are turned off (step 704). If a display mode has not been selected, the lamp is turned on, a display mode is set up (step 705), and determines outputs of the thermistors 28 and 54 every five minutes (step 706) while sequentially updating the fixing temperature display 118 (step 707). If the temperature display key 114 has not been pressed, the program is transferred to a step 708.

Figure 8:
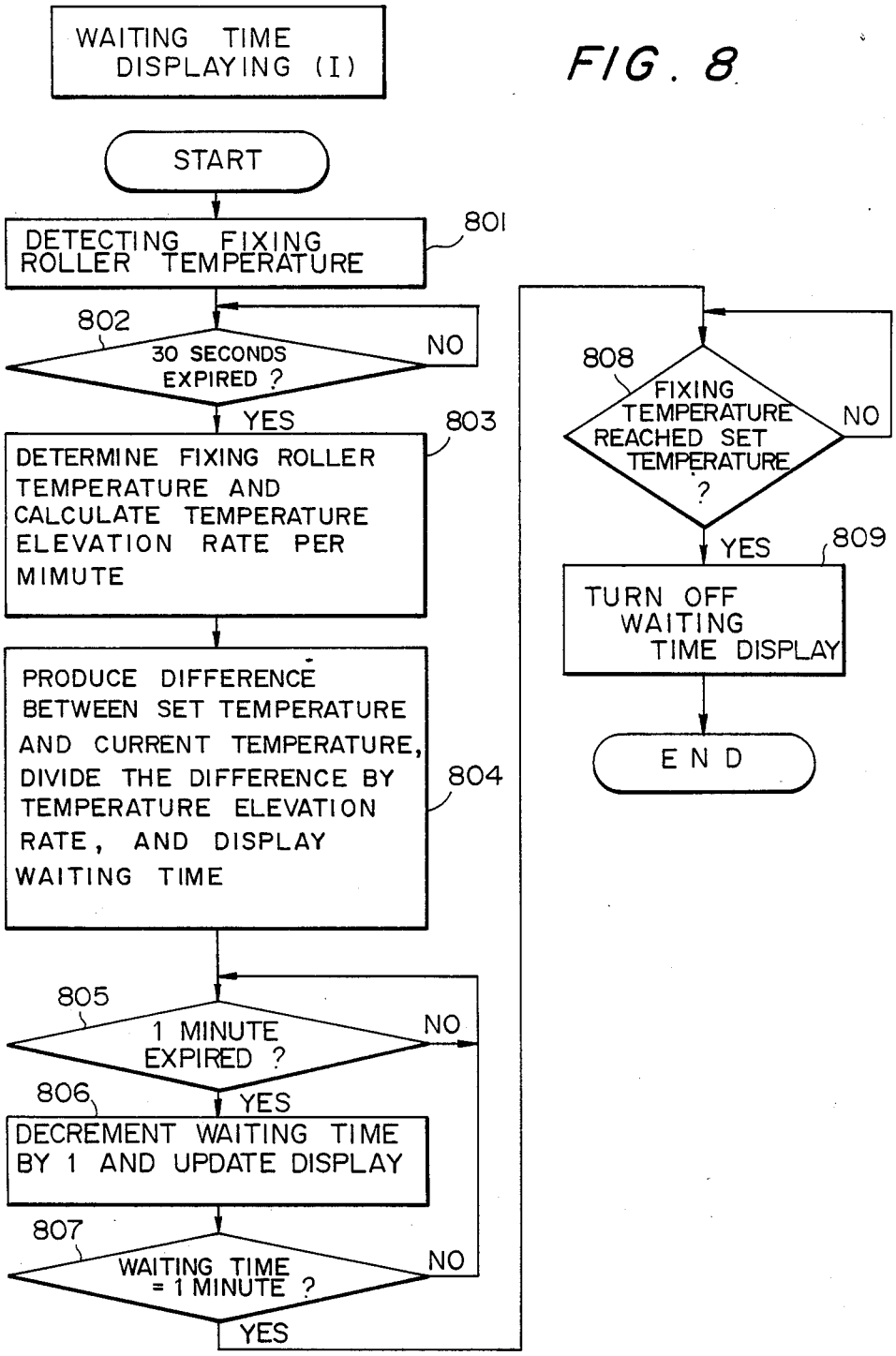
FIG. 8 is a flowchart representative of a control procedure associated with the display of a waiting time.

FIG. 8 is a flowchart demonstrating the operation of the control system 32 for displaying a waiting time. When the power source of the machine is turned on or when AC turns from OFF to ON, the system 32 determines the instantaneous temperature of the fixing roller 12 (step 801). Then, the system 32 determines whether a predetermined period of time such as 30 seconds has expired (step 802) and, if it has expired, detects the temperature of the fixing roller 12 again. The CPU 88 calculates a temperature elevation rate per unit time such as one minute (degrees/minute) (step 803), a difference between the set fixing temperature and the actual temperature, and a time produced by dividing the temperature difference by the temperature elevation rate. The resulting waiting time is displayed on the waiting time display 507 (step 804). The waiting time appearing on the display 507 is sequentially decremented by 1 (one) every minute (steps 805 to 807). Thereafter, the system 32 determines whether the actual fixing temperature has reached the set temperature (step 808) and, if the answer is YES, brings the machine into a ready state while turning off the waiting time display (step 809).

Figure 9:
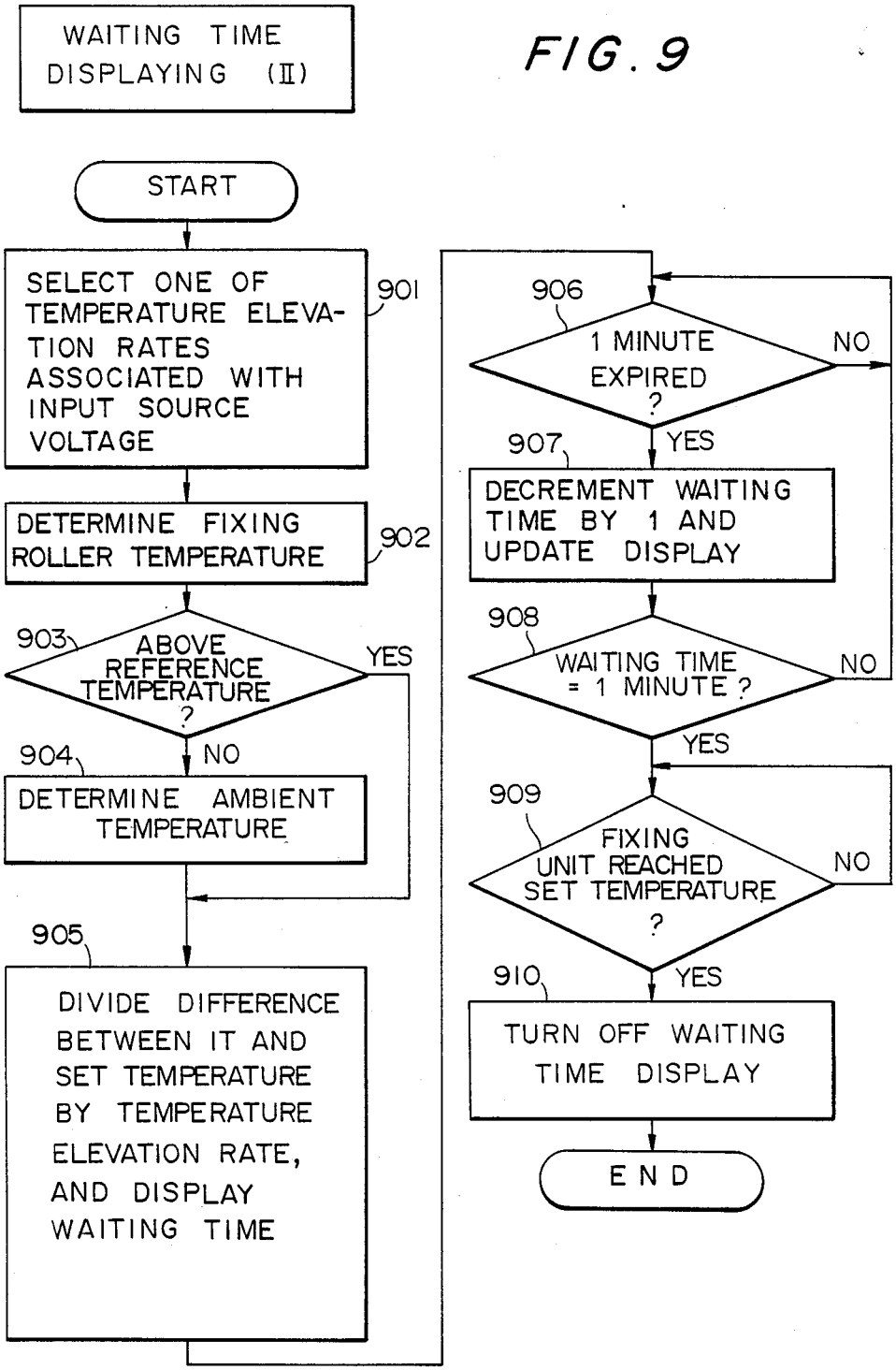
FIG. 9 is a flowchart showing an alternative control procedure associated with the display of a waiting time.

An alternative control procedure associated with the display of a waiting time is shown in FIG. 9. As shown, when the power switch is turned on or when AC turns from OFF to ON, the system 32 causes the AD converter 110 to read a DC voltage which is produced by lowering, rectifying and smoothing the input source voltage. Several temperature elevation rates (degrees/-minute) each being associated with a different input voltage are stored beforehand. One of such temperature elevation rates stored is selected on the basis of the current input voltage which is read by the AD converter 110 (step 901). Then, the system 32 determines the temperature of the fixing roller 12 through the thermistor 28 (step 902). Comparing and computing means compares the current temperature of the fixing roller with a predetermined reference temperature (step 903). If the actual roller temperature is higher than the reference temperature, the CPU 88 computes a temperature elevation rate per unit time such as one minute (degrees/minute) by using the temperature sensed by the thermistor 28, a difference between the set fixing temperature and the instantaneous temperature, and a period of time which is produced by dividing the temperature difference by the temperature elevation rate, the resulting waiting time being indicated on the waiting time display 124 (step 905). The waiting time appearing on the display 124 is sequentially decremented by 1 every minute (steps 906 to 908). Thereafter, the system 32 determines whether the actual fixing temperature has reached the set temperature (step 909) and, if the result of decision is YES, brings the machine into a ready condition while turning off the waiting time display (step 910). When the actual temperature of the fixing roller 12 is lower than the reference temperature as determined by the comparing and computing means, the program decides that the machine is started in the morning when the ambient temperature is comparatively low. Then, the ambient temperature is sensed by the thermistor 54 (step 904). This is followed by determining a difference between the sensed ambient temperature and the set fixing temperature, dividing the temperature difference by the temperature elevation rate selected to produce a waiting time, and displaying the waiting time on the waiting time display 124 (step 905). What follows the step 905 is the same as the procedure shown in FIG. 8.

In summary, in accordance with the present invention, a waiting time necessary for the warm-up of an image forming apparatus is determined by calculating an elevation rate of fixing temperature within a predetermined time interval and, based on the elevation rate, producing a difference between the current temperature of a fixing unit and a set fixing temperature. The waiting time is therefore determined with unprecedented accuracy taking account of the instantaneous temperature inside the apparatus and power for heating.

The waiting time is determined on the basis of the temperature inside the apparatus when the ambient temperature is comparatively low and on the basis of the temperature of the fixing unit when the ambient temperature is higher than a predetermined threshold level. This further enhances accurate detection of a temperature elevation rate and therefore accurate display of waiting time.

Various modifications will become possible for those skilled in the art after receiving the teachings of the present disclosure without departing from the scope thereof.

What is claimed is:

1. In an image forming apparatus including a fixing unit, a device for determining and displaying a waiting time necessary for said fixing unit to reach an operable temperature, comprising:

fixing unit temperature sensing means for sensing a temperature of said fixing unit;

control means for calculating a temperature elevation rate per unit time from temperatures of said fixing unit which are sensed at a predetermined time interval, producing a difference between an actual temperature of said fixing unit and a reference fixing temperature set beforehand, and dividing the temperature difference by the temperature elevation rate to produce the waiting time; and display means for displaying the waiting time produced.

2. A device as claimed in claim 1, wherein said control means controls said display means such that the waiting time appearing on said display means is sequentially decremented by one at a time and, when the instantaneous temperature of said fixing unit reaches the reference fixing temperature, the waiting time on said display means disappears.

3. A device as claimed in claim 1, wherein the predetermined time interval is 30 seconds.

4. A device as claimed in claim 1, wherein the unit time is 1 minute.

5. In an image forming apparatus including a fixing unit, a device for determining and displaying a waiting time necessary for said fixing unit to reach an operable temperature, comprising:

display means for displaying the waiting time;

fixing unit temperature sensing means for sensing a temperature of said fixing unit;

ambient temperature sensing means for sensing a temperature of the ambience;

computing means for comparing a temperature of said fixing unit sensed by said fixing unit temperature sensing means and a predetermined reference temperature; and control means for determining the waiting time on the basis of a temperature sensed by said fixing unit temperature sensing means when the temperature of said fixing unit is higher than the reference temperature and on the basis of a temperature sensed by said ambient temperature sensing means when the temperature of the fixing unit is lower than the reference temperature, while causing said display means to display the waiting time.

6. A device as claimed in claim 5, further comprising heating means for heating said fixing unit, and input voltage determining means for determining an input voltage which is applied to said heating means.

7. A device as claimed in claim 6, wherein said control means stores beforehand a plurality of temperature elevation rates each being associated with a different input voltage which is applied to said heating means. and selects one of the temperature elevation rates in response to the input voltage determined.

8. A device as claimed in claim 7, wherein said control means determines the waiting time, when the sensed temperature of the fixing unit is higher than the reference temperature, by producing a difference between an instantaneous temperature of said fixing uit and a fixing temperature set beforehand and dividing the resulting temperature difference by the temperature elevation rate selected and, when the sensed temperature of the fixing unit is lower than the reference temperature, by producing a difference between the ambient temperature sensed and a fixing temperature set beforehand and dividing the resulting temperature difference by the temperature elevation rate selected.

9. A device as claimed in claim 5, wherein said control means controls said display means such that the waiting time appearing on said display means is sequentially decremented by one at a time and, when the instantaneous temperature of said fixing unit reaches the reference fixing temperature, the waiting time on said display means disappears.

* * * * *